US005503433A

United States Patent [19]

Lachapelle

[11] Patent Number: 5,503,433

[45] Date of Patent: Apr. 2, 1996

[54] DEVICE FOR BLOCKING WHEELS OF ROLLER SKATES

[76] Inventor: Luc Lachapelle, 60, rue Milton, Montréal, Quebec, Canada, H2X 1V3

[21] Appl. No.: 335,377

[22] Filed: Nov. 3, 1994

[51] Int. Cl.[6] ..... A63C 3/12

[52] U.S. Cl. ..... 280/825; 36/132; 188/4 R; 280/11.22; 280/811

[58] Field of Search ..... 280/809, 811, 280/825, 816, 11.2, 11.21, 11.22; 188/4 R, 32; 294/150, 151, 153, 154, 156, 158, 141, 143, 145; 482/223, 224; 224/246, 250, 255; 36/115, 132, 7.5, 15

[56] References Cited

U.S. PATENT DOCUMENTS

| | | | |
|---|---|---|---|
| 1,699,114 | 1/1929 | Meagher | 294/151 |
| 2,887,184 | 5/1959 | Snee | 188/4 R |
| 3,600,734 | 8/1971 | Pollinger | 224/250 |
| 3,861,697 | 1/1975 | Dolle | 280/825 |
| 3,898,749 | 8/1975 | Famolare | 280/825 |
| 4,331,357 | 5/1982 | Contreras | 280/811 |
| 4,355,474 | 10/1982 | Grim | 36/132 |
| 4,364,187 | 12/1982 | Melendez | 36/15 |
| 4,413,842 | 11/1983 | Loredo | 280/825 |
| 4,911,456 | 3/1990 | Sarazen | 280/11.2 |
| 5,171,032 | 12/1992 | Dettmer | 280/11.2 |
| 5,236,224 | 8/1993 | Anderson et al. | 280/825 |
| 5,290,065 | 3/1994 | Kassal | 280/825 |
| 5,303,955 | 4/1994 | Zurnamer | 280/825 |
| 5,445,415 | 8/1995 | Campbell | 280/11.22 |

*Primary Examiner*—Anne Marie Boehler
*Attorney, Agent, or Firm*—ROBIC

[57] ABSTRACT

An accessory device for a roller skate is disclosed, for use to block the wheels of this roller skate. This device comprises a plurality of elongated members that are made of non-slippery material and sized to snugly fit transversely between two of the wheels. These members are linked together, preferably by an elastic rope which is forming a closed loop. The device can be secured to the frame of the roller skate whenever required by placing each member between two of the wheels to prevent the same from rotating. This device is very advantageous because it is inexpensive and very simple to install on a roller skate. It is also very light in weight and compact, thereby making it easy to carry.

10 Claims, 2 Drawing Sheets

FIG. 1
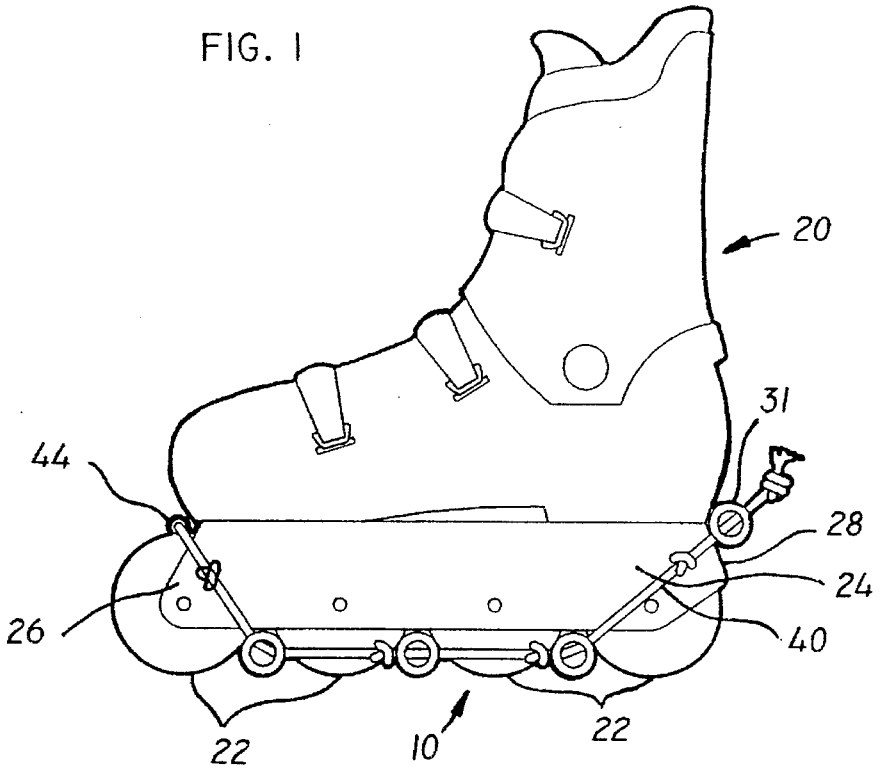
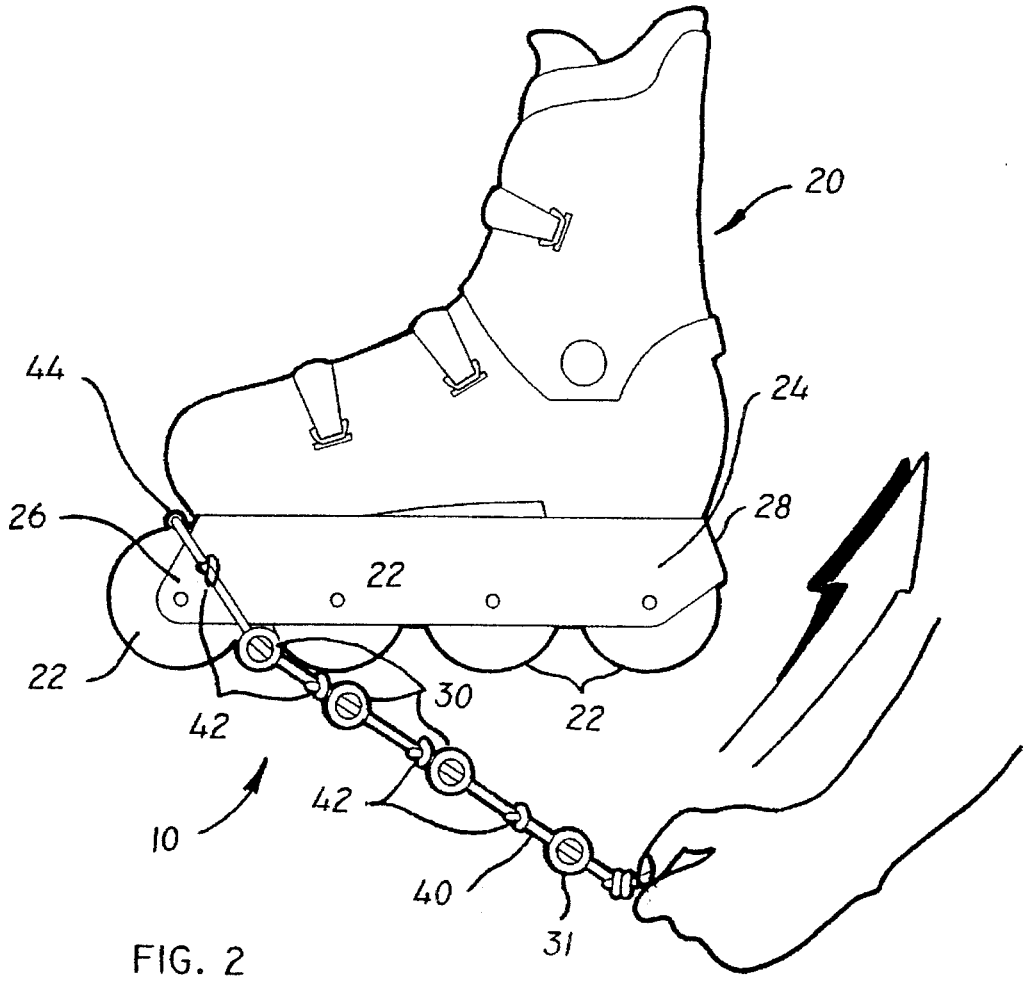
FIG. 2

DEVICE FOR BLOCKING WHEELS OF ROLLER SKATES

FIELD OF THE INVENTION

The present invention relates to accessories for roller skates. More particularly, the invention relates to a device for blocking the wheels of roller skates whenever required, such as for example, when the person wearing the roller skates wants to walk or climb stairs.

BACKGROUND OF THE INVENTION

Roller skates are well known products, and have always been popular. Over the last years, in-line type roller skates, also called "roller blades" have had a tremendous success and opened a market that expands rapidly. Such roller skates are fun to use when the skater is moving at a certain speed, fast enough to make the wheels roll underneath. However, if the skater wants to stop and remain stable, or if he has to climb up or down stairs or just wants to walk with his or her roller skates on, the roller skates with their rotating wheels become extremely unstable and are therefore dangerous for the user. A solution to this problem is to find a way or a device for immobilizing the wheels whenever required by the user. Such device should also be easy and quick to install onto the skates. Moreover, such device should be of a practical compact size so as to allow the user to carry it without any inconvenient.

Prior art attempts to satisfy this need include devices exclusively adapted for use on conventional roller skates provided with tandem wheels. Devices of this type are described, by way of examples, in U.S. Pat. Nos. 4,355,474; 4,364,187 and 4,413,842. Other prior art attempts have been made to provide devices adapted for use on in-line roller skates, such devices generally comprising a cover or an envelope for covering the wheels. Examples of such devices are described, by way of examples, in U.S. Pat. Nos. 5,236,224; 5,290,065 and 5,303,955. If these existing devices are efficient, they are either not very compact or often require some time to be fixed to the roller skates.

For the foregoing reasons, there is presently a need for a device for blocking the wheels of rollers skates whenever required, which would be of low cost and easy to carry and would allow quick and easy installation onto the roller skates.

SUMMARY OF THE INVENTION

The object of the present invention is to provide a device for blocking the wheels of a roller skate, that satisfies the above need.

More particularly, the object of the present invention is to provide a device for blocking the wheels of a roller skate having a plurality of wheels mounted in close relationship onto a frame having a front and a rear end.

The device according to the present invention comprises a plurality of elongated members made of non-slippery material and a connecting means. The elongated members are sized to snugly fit transversely between two of the wheels. The purpose of the connecting means is to link the elongated members together in such a manner that the members extend substantially parallel to each other. The connecting means is also devised to act as a fixation means for securing the device to the frame whenever required in such a manner that each member extends transversely to the frame between two of the wheels and thus prevents the wheels from rotating.

According to a preferred embodiment of the invention, the elongated members have two opposite ends and the connecting means consists of a rope to which the opposite ends are attached. The rope forms a closed loop that is sized to be removably connected to the front and rear end of the frame, for fixation purposes.

According to another preferred embodiment of the invention, the elongated members consist of cylinders, and more preferably of hollow cylinders. These cylinders have one transversal hole in the vicinity of each opposite end. Each of the opposite ends is attached to the rope by passage of the rope through each of the transversal holes.

According to a further preferred embodiment of the invention, the device can be adapted for use with an in-line roller skate which has at least three longitudinally aligned wheels, one of these wheels being mounted at the rear end of the frame, and may also have a brake member fixed to the rear end of the frame and extending downwardly from the frame. In such a case, the device according to the invention may further comprise an additional elongated member positioned to extend either transversely onto the rear end of the frame, if the skate does not have a brake, or between the wheel mounted at the rear end of the frame and the brake, if the skate has a brake.

In still another preferred embodiment of the invention, the elongated members are spaced apart from each other and have a front side facing the front end of the frame, and the rope further comprises a plurality of spaced-apart knots. Each of the knots is lying close to each one of the holes on the front side of each member for preventing the members from sliding towards the front end of the frame when the device is connected to the frame.

In all the preferred embodiments described hereinbefore, the rope is preferably made of an elastic material and the members are preferably made of a polymeric material such as rubber.

A non restrictive description of a preferred embodiment of the invention will now be given with reference to the appended drawings.

BRIEF DESCRIPTION OF THE DRAWINGS

FIG. 1 is a side elevational view showing a device according to the present invention secured onto the frame of an in-line roller skate;

FIG. 2 is a view similar to FIG. 1, showing the way the device according to the invention can be installed onto the skate;

DESCRIPTION OF A PREFERRED EMBODIMENT

Figure 3:
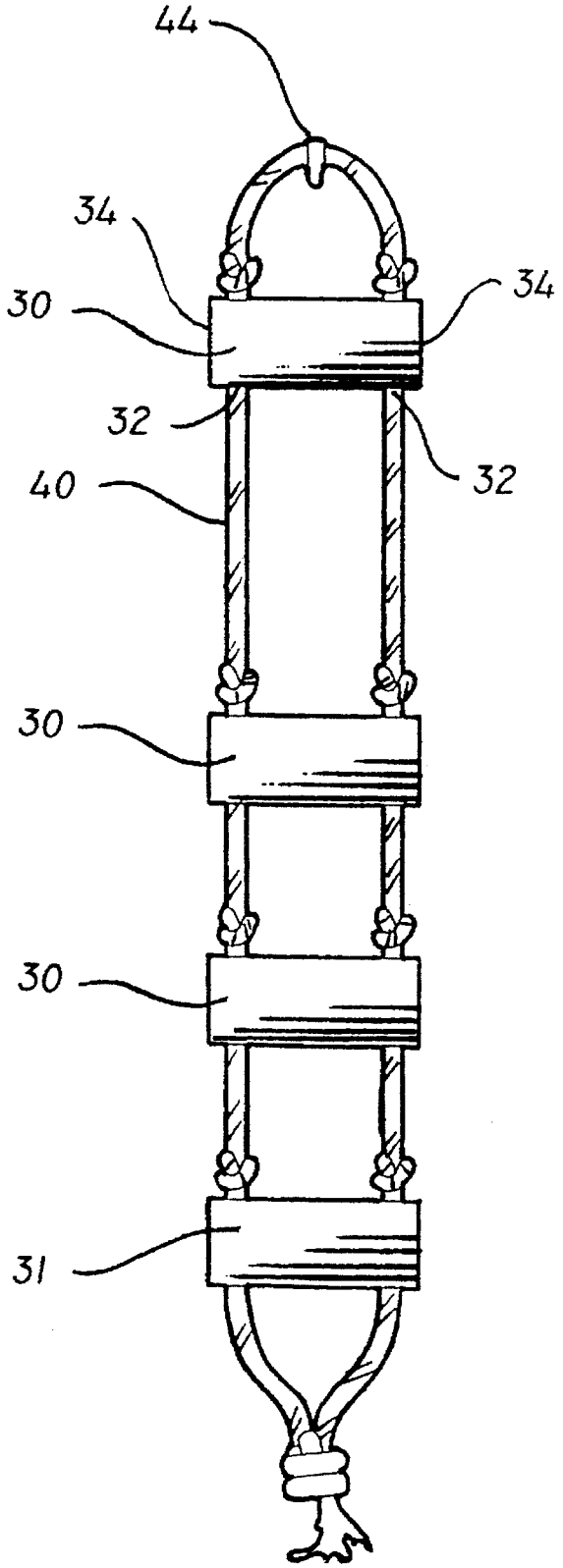
FIG. 3 is a top plan view of the device shown in use in FIGS. 1 and 2.

FIGS. 1 and 2 show a device 10 for blocking the wheels 22 of a roller skate according to the present invention. The device 10 is shown in use for blocking the wheels of an in-line roller skate 20. Obviously, a similar device could also be used on a conventional roller skate provided with tandem wheels or on roller skates having asymetric wheels.

The in-line roller skate 20 which is shown in FIGS. 1 and 2 comprises four longitudinally aligned wheels 22. However, the present invention could also be used on an in-line roller skate having more or less than four wheels. As shown in FIGS. 1 and 2, these wheels 22 are mounted in close relationship onto a frame 24 which has a front and a rear end (26, 28). The roller skate 20 may also be provided with a brake member (not shown) fixed to the rear end 28 of the frame 24 and extending downwardly from the frame 24. This basic structure is conventional for an in-line roller skate and does not need to be described further.

The device 10 according to the invention comprises a plurality of elongated members 30 and a connecting means 40. In the illustrated embodiment of the invention, this connecting means consists of a rope.

These members 30 may have the shape of hollow cylinders as illustrated. However, they could also be of a different cross-sectional shape and be solid instead of hollow. In all cases however, these members 30 must be elongated. They must also be made of non-slippery material such as rubber and be sized to snugly fit transversely between two of the wheels 22.

In the illustrated embodiment, these members 30 are linked together by the passage of the rope 40 through transversal holes 32 made in the vicinity of each of their opposite ends 34. The members 30 are linked together in such a manner that they extend substantially parallel to each other. It is worth mentioning that the members 30 could also be linked together by simply attaching the ends 34 of each member 30 to the rope 40. In fact, any method allowing linkage of the members 30 together may be used in accordance with the present invention, provided that the members 30 are linked in such a manner that they extend substantially parallel to each other.

As can be seen in FIGS. 1 and 2, the rope 40 is devised to act as a fixation means for securing the device 10 whenever required, in such a manner that each member 30 extends transversely to the frame 24 between two of the wheels 22 and thus prevents the wheels 22 from rotating. In the illustrated embodiment, the device 10 is further provided with an additional member 31 which extends transversely, onto the rear end of the frame 28, as illustrated. If the roller skate is provided with a brake member, this additional member 31 may be inserted between the wheel at the rear end of the frame and the brake.

Figure 4:
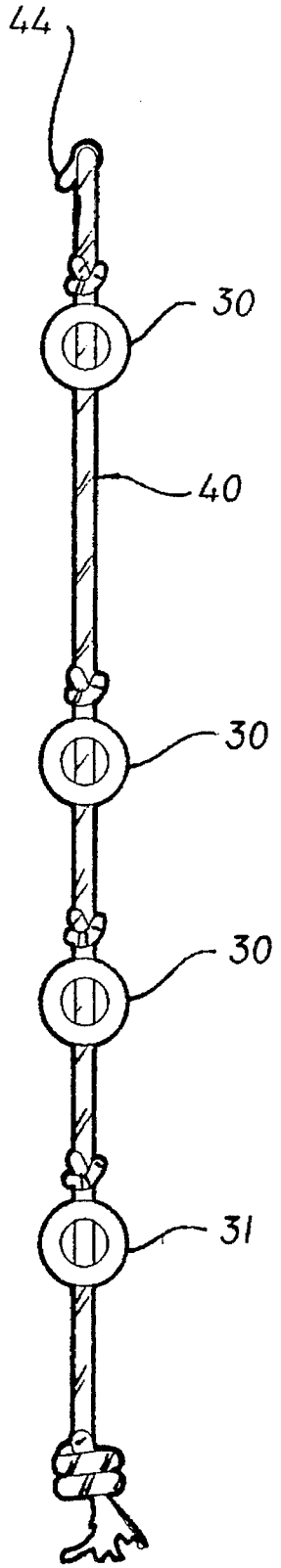
FIG. 4 is a side elevational view of the device shown in FIG. 3.

The device, as shown in FIGS. 1–4, may also be provided with a stopping component 44 made either of plastic, metal or rubber and linked together with the members. This stopping component 44 extends transversely onto the front end of the frame 28 and is for preventing the front wheel from rolling and thus prevents the rope from being released from the front end. In another preferred embodiment, this stopping component 44 could easily be identical to the elongated members.

Preferably, as illustrated in FIGS. 1–4, the rope 40 is made of an elastic material and forms a closed loop. Such loop can be made by tying the extremities of a length of rope together (as in FIGS. 1–4). Of course, the loop is sized to be removably connectable to the front and rear end of the frame (26, 28), as shown in FIG. 2.

As can be seen in the drawings, the rope 40 may advantageously be provided with a plurality of spaced-apart knots 42. The purpose of these knots 42 is to facilitate the installation of the device 10 on the frame 24 by preventing the members 22 from sliding towards the front or rear end of the frame 24 during the installation. They are also adjustable, in other words, the distance between each knot can vary depending on the kind of skate used. Thus, the rope should have knots so that one knot 42 extends close to each of the holes 32 on the front side of each members 30, i.e. on the front portion of each member facing the front end of the frame 30.

The device according to the present invention is believed to be particularly advantageous as compared to the other known devices allowing the immobilization of the wheels of the roller skate. Indeed, it is inexpensive and very simple to install on a roller skate. It is also light in weight and compact. Thus, a skater can carry a pair of these very easily. For example, it could be carried in a pocket, in a bag or preferably around a wrist or an ankle.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. The combination of:

(a) a roller skate comprising a plurality of wheels mounted in close relationship onto a frame having a front and a rear end; with (b) a device for blocking the wheels of said roller skate, said device comprising:

a plurality of elongated members made of non-slippery material, each of said members being sized to snugly fit transversely between two of said wheels; and connecting means for linking the members together in such a manner that they extend substantially parallel to each other, said connecting means also acting as fixation means for securing the device to the frame in such a manner that each member extends transversely to the frame between two of said wheels and thus prevents said wheels from rotating.

2. The combination of claim 1, wherein:

each elongated member has two opposite ends; and said connecting means consists of a rope to which said opposite ends are attached, said rope forming a closed loop that is removably connected to the front and rear end of the frame for fixation purposes.

3. The combination of claim 2, wherein the elongated members are cylindrical in shape.

4. The combination of claim 2, wherein:

the elongated members consist of hollow cylinders, each having one transversal hole in the vicinity of each opposite end; and each of said opposite ends is attached to the rope by passage of said rope through each of said transversal holes.

5. The combination of claim 4, wherein:

the rope is made of an elastic material.

6. The combination of claim 5, wherein:

the elongated members are spaced apart from each other and have a front side facing the front end of the frame; and the rope further comprises a plurality of spaced-apart knots, each of said knots lying close to one of said holes on the front side of each member for preventing said members from sliding towards the front end of the frame.

7. The combination of claim 6, further comprising an additional elongated member positioned to extend transversely onto the rear end of the frame.

8. The combination of claim 6, wherein:

the elongated members are made of a polymeric material.

9. The combination of claim 8, wherein:

the polymeric material is rubber.

10. The combination of:

(a) an in-line roller skate comprising:

a frame having a front and a rear end; and at least three linearly aligned wheels mounted in close relationship onto the frame; with (b) a device for blocking the wheels of said in-line roller skate, said device comprising:

a plurality of elongated spaced-apart members made of rubber and consisting of hollow cylinders, said members being sized to snugly fit transversely between two of said wheels and each having two opposite ends with one transversal hole in the vicinity of each opposite end; said elongated member also having a front side facing the front end of the frame; and an elastic rope for linking the members together by passage of said rope through each of said transversal holes, said rope forming a closed loop removably connected to the front and rear end of the frame for securing the device to the frame in such a manner that each member extends transversely to the frame between two of said wheels and thus prevents said wheels from rotating, said rope also having a plurality of spaced-apart knots, each of said knots lying close to one of said holes on the front side of each member for preventing said members from sliding towards the front end of the frame; and an additional member extending transversely at the rear end of the frame.

* * * * *